US012196525B2

(12) United States Patent
Schweizer

(10) Patent No.: US 12,196,525 B2
(45) Date of Patent: Jan. 14, 2025

(54) PISTOL ACCESSORY, PISTOL AND USE OF THE PISTOL

(71) Applicant: Adrian Schweizer, Wabern (CH)

(72) Inventor: Adrian Schweizer, Wabern (CH)

( * ) Notice: Subject to any disclaimer, the term of this patent is extended or adjusted under 35 U.S.C. 154(b) by 51 days.

(21) Appl. No.: 18/113,077

(22) Filed: Feb. 23, 2023

(65) Prior Publication Data

US 2023/0408223 A1 Dec. 21, 2023

(51) Int. Cl.
*F41C 23/12* (2006.01)
*F41C 3/00* (2006.01)

(52) U.S. Cl.
CPC ..... *F41C 23/12* (2013.01); *F41C 3/00* (2013.01)

(58) Field of Classification Search
CPC ..... F41A 3/72; F41C 23/12; F41C 27/00
See application file for complete search history.

(56) References Cited

U.S. PATENT DOCUMENTS

| | | | | |
|---|---|---|---|---|
| 9,194,654 | B1 * | 11/2015 | Viani | F41C 27/00 |
| 11,287,199 | B1 * | 3/2022 | Cahill | F41A 3/72 |
| 11,549,768 | B1 * | 1/2023 | Pischke | F41G 1/06 |
| 2023/0029097 | A1 * | 1/2023 | Santa | F41A 3/72 |

* cited by examiner

*Primary Examiner* — J. Woodrow Eldred
(74) *Attorney, Agent, or Firm* — Kolisch Hartwell, P.C.

(57) ABSTRACT

A pistol accessory including an actuating member (5) that can be fastened to the rear end of a slide (4) of a pistol (1), the actuating member (5) including a gripping access (5*a*) which, when arranged on the slide (4), has a gripping access (5*a*) accessible from below through a lower access plane, where a person using the pistol (1), relative to the upper cover section (4*b*) of the slide (4), can engage from below with a finger, where the pistol accessory may additionally include a housing (11) which can be fastened to the grip section (2) of the pistol (1), which can be used to form a pistol (1) which can be held for a targeted firing by one person at the grip (2) and at the housing (11), with one hand each, and can be supported laterally with the housing (11) at a cheek.

11 Claims, 2 Drawing Sheets

PISTOL ACCESSORY, PISTOL AND USE OF THE PISTOL

FIELD

The invention relates to a pistol accessory, to a pistol with this accessory, and to the use of such a pistol.

BRIEF DESCRIPTION OF THE DRAWINGS

With the aid of some drawings figures, the invention is described in more detail below. In the drawings.

DETAILED DESCRIPTION

Figure 1:
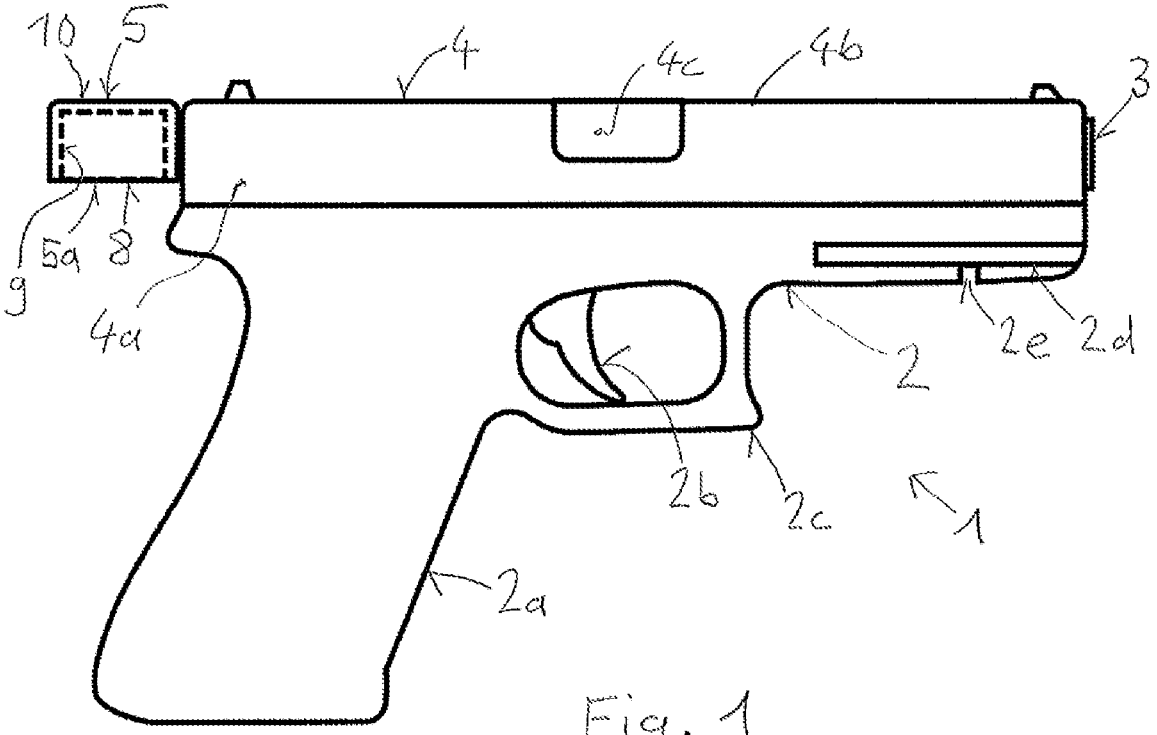
FIG. 1 is a schematic side view of a pistol with an actuating member located at the rear end of the slide.
Figure 2:
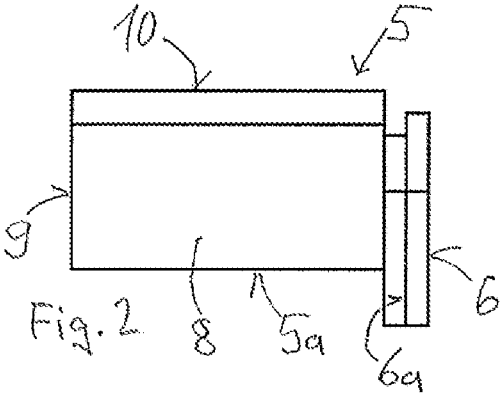
FIG. 2 is a side view of the actuating member.
Figure 3:
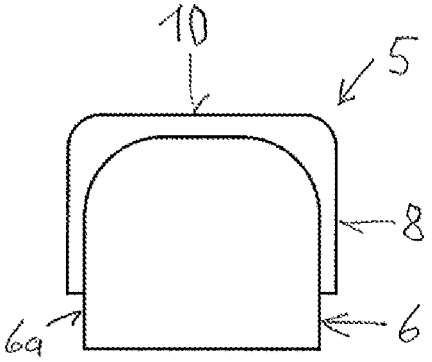
FIG. 3 is a front view of the actuating member on its fastening mechanism.
Figure 4:
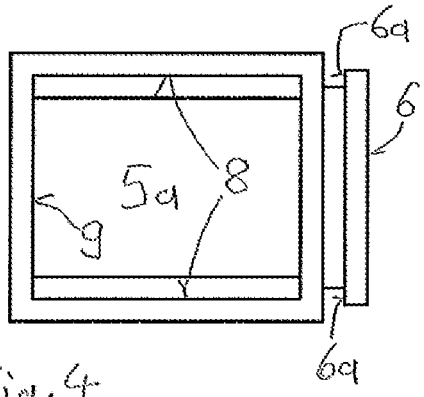
FIG. 4 is a bottom view of the actuating member.
Figure 5:
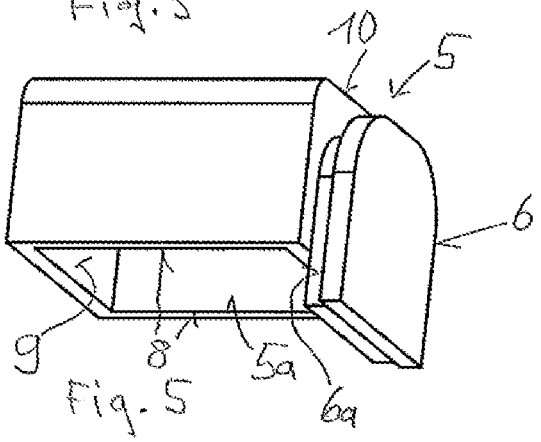
FIG. 5 is a perspective view of the actuating member.
Figure 6:
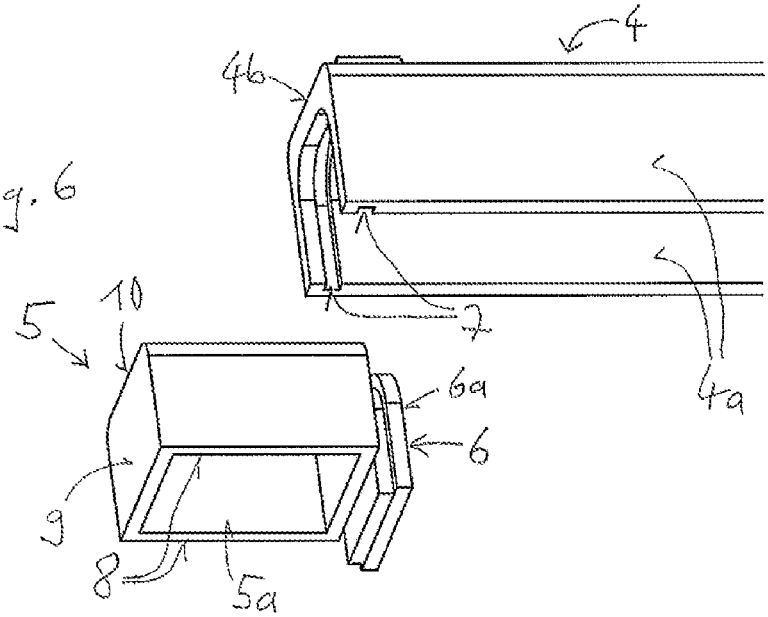
FIG. 6 is a perspective view of the actuating member before it is fastened to the slide of the pistol.

The pistol accessory is associated with a pistol having a grip section, a barrel, and a slide or breechblock that is movable relative to the grip section and barrel. The grip section includes at least a grip, a trigger, and a guard partially surrounding the trigger. The barrel, the slide and a trigger-operated release mechanism for firing a cartridge located in the barrel are arranged on the grip section.

The slide of the pistol includes an ejection window in a lateral and upper area, which is closed when a cartridge is fired and is opened after firing due to a movement sequence between the slide and the barrel in order to eject the case of the fired cartridge laterally upwards. When a new cartridge is inserted in the barrel, the ejection window is closed again. For manual actuation of the slide movement, the slide of the known pistols is freely accessible on both sides and is usually provided with ribs there for better gripping.

To enable a repeating movement of the breechblock, many pistols use a spring mechanism which is tensioned by the slide movement triggered by firing and then enables the slide to be reset.

US 2014/0298703 A1 describes an adapter that can be attached to the rear end face of a slide. The slide extends along a longitudinal axis and has two side walls to the side of the longitudinal axis and an upper cover section above the longitudinal axis connecting the side walls. The outer surfaces of the side walls abut side planes, which laterally limit the extension of the slide. On the rear end face of the slide, there are receiving grooves open towards the longitudinal axis in the two side walls and in the ceiling area for inserting the adapter. The adapter comprises a first and a second plate element, which are connected to each other in their central areas by a connecting bridge. A gripping area of the first plate element can be inserted from below into the receiving grooves of the slide. After complete insertion, the adapter is fixed to the slide.

When the adapter is fastened to the slide with the first plate element, the connecting bridge extends midway between the side planes of the slide from the lower end section of the adapter to its upper end. The second plate element forms a fitting section, with only one receiving groove being formed on each side of the connecting bridge between the second plate element and the first plate element or the rear end face of the slide.

An actuating member projecting over the side walls of the slide can now be fit onto the second plate element of the adapter from above, so that bridges of the actuating member extending orthogonally to the upper cover section and projecting against the longitudinal axis are received in the receiving grooves between the second plate element and the rear end face of the slide. With an actuating member fit on the adapter, an end closed from all sides is created at the rear end of the slide, which is wider and/or higher than the slide. The increased width or height improves the gripping ability and facilitates manual operation of the slide movement.

Instead of the actuating member fit on the adapter, a sighting element is also disclosed which closes off the slide on all sides at the rear end face, is arranged on the adapter and projects over the slide.

The accessories described in US 2014/0298703 A1, which are arranged on the slide, protrude from the side walls and/or from the cover section of the slide and, during the movement of the slide, may engage with the person or the clothes of the person using the pistol and cause disturbances in the use of the pistol. Such disturbances can also occur if the pistol is held close to an object, such as a house wall, when firing.

CA 2 631 979 describes a housing that is fastened to the grip section and partially encloses the slide and the barrel of the pistol. In the section of the ejection window of the slide, the housing has an opening through which cartridge cases can exit the housing. For manual operation of the slide movement, the housing has another opening. An actuating member fastened to the side of the slide protrudes from the housing through this another opening. This actuating member may also interfere with the person or clothing of the person using the weapon during slide movement and cause disturbances in the use of the pistol. Disturbances resulting from the laterally protruding actuating member can also occur if the pistol is held close to an object, such as a house wall, when firing.

CA 2 631 979 describes a shoulder rest fastened to the housing in addition to the housing. When firing, the shoulder rest can be placed against the shoulder, and the grip section can be held with one hand and the case with the second hand. This results in a three-point support of the pistol. This three-point support is advantageous for precise firing. In addition to the disturbing, laterally protruding actuating member moved with the slide, the recoil acting on the shoulder via the shoulder rest during firing can also lead to disturbances in the aiming accuracy. In addition, depending on the shooting position and the shooter's equipment (e.g. vest with ballistic plates); it may be difficult to support the shoulder rest at all on the shoulder as intended.

The problem of the invention is to find a solution that reduces the possible disturbances caused by the slide movement.

This problem is solved by a pistol accessory having the features of claim 1. The dependent claims describe advantageous embodiments which solve further problems.

As part of an inventive step, it was recognized that manual operation of the slide should not be accomplished by gripping the slide or members projecting therefrom at the side walls or at the upper cover section. It was recognized that for manual operation, a pistol accessory in the form of an actuating member is to be arranged on the rear end face of the slide, which actuating member, when arranged on the slide, has a gripping access accessible from below through a lower access plane, into which a person using the pistol can engage with a finger from below or from the direction facing away from the upper cover section. The actuating member comprises a fastening mechanism with which it can be fastened to the slide at the rear end face.

The pistol accessory of the invention comprises a connecting mechanism for connecting the pistol accessory to a pistol comprising a grip section, a barrel, and a slide slidable relative to the grip section and the barrel and extending along a longitudinal axis and having two side walls and an upper cover section connecting the side walls at the top, and an ejection window for ejecting cartridge cases. In addition, the pistol accessory includes an actuating member that can be fastened to the rear end of the slide of a pistol. In the state in which it is arranged on the slide, the actuating member has a gripping access accessible from below through a lower access level, into which a person using the pistol can engage from below with a finger relative to the upper cover section of the slide.

The fastening mechanism of the actuating member preferably comprises at least one engagement bridge for insertion into at least one matching receiving groove of the slide, wherein the at least one engagement bridge extends away from the lower access plane of the gripping access relative thereto and thereby from the bottom to the top. In the fully inserted position of the at least one engagement bridge, the actuating member is fixed to the slide. In the advantageous embodiment of the actuating member, a bottom-up direction corresponds to the orientation of the at least one engagement bridge. The gripping access accessible from below is thus accessible in the direction of the engagement bridge.

According to a further advantageous embodiment, a connecting member leads from the fastening mechanism to a grip plate spaced from the fastening mechanism, wherein the connecting member between the fastening mechanism and the grip plate leaves a central section free as a gripping access for access with a finger.

An advantageous actuating member does not protrude outward beyond the side walls and the upper cover section of the slide when the slide is in place.

In another advantageous embodiment of the actuating member, the connecting member comprises at least two lateral wall sections which extend in the extension of the side walls of the slide when the actuating member is fastened to the slide. If necessary, the actuating member comprises, in addition to the two lateral wall sections, a cover section which, in the case of an actuating member fastened to the slide, extends in the extension of the upper cover section. In an advantageous embodiment, the grip plate forms the rear end face of the actuating member. The central section for access with a finger, or the gripping access, is thus surrounded by the two lateral wall sections, the cover section, the grip plate and the fastening mechanism, and is only accessible from below, or from the side facing away from the cover section.

In addition to the actuating member, an advantageous embodiment of the pistol accessory comprises a housing which can be fastened to the grip section of the pistol and, in the fastened state, encloses the slide and the actuating member fastened to the slide in all slide positions, at least laterally and at the top, and has an ejection opening in a lateral and upper section which is associated with the ejection window of the slide, so that a cartridge case exiting from the ejection window also exits through the ejection opening.

The housing is open on its bottom side, at least at the actuating member, so that it is possible to reach from below with a finger into the gripping access of the actuating member. Preferably, the housing at the actuating member is open only on its bottom side.

The actuating member is then covered by the housing at the sides and top in all slide positions.

In an advantageous embodiment of the housing, the housing comprises a fitting section which is adapted to a corresponding section of the grip section, so that the housing can be fixed to the grip section by a fitting movement over the barrel of the pistol along the longitudinal axis of the slide.

In another advantageous embodiment of the housing, the housing includes at least one connecting section configured to stably and accurately hold an aiming device.

According to an advantageous embodiment, the connecting section comprises at least one bridge to which a groove of the aiming device can be fixed.

The arrangement of the advantageous pistol accessory on a pistol, namely the arrangement of the actuating member on the slide and the housing on the grip section, results in a pistol according to the invention, which enables use according to the invention.

In the use according to the invention, the pistol is held for a targeted firing by a person at the grip section and at the housing, with one hand each, and is laterally supported with the housing at a cheek of this person. With this three-point support of the pistol according to the invention, there are no disturbing elements projecting laterally and moved with the slide, and the recoil from firing does not have to be absorbed in a direct line by a shoulder. The recoil only results in a movement 15 of the housing tangential to the jaw.

FIG. 1 shows a pistol 1 with a grip section 2, a barrel 3 and a slide 4 that is slidable relative to the grip section 2 and the barrel 3 and extends along a longitudinal axis. The slide 4 includes two side walls 4*a* and an upper cover section 4*b* connecting the side walls 4*a* at the top, as well as an ejection window 4*c* for ejecting cartridge cases. The grip section 2 includes at least a grip 2*a*, a trigger, 2*b* and a guard 2*c* partially surrounding the trigger 2*b*.

A pistol accessory in the form of an actuating member 5 is fastened to the rear end of the slide 4 of the pistol 1. According to FIGS. 1 to 7, the actuating member 5 in the state arranged on the slide 4 has a gripping access 5*a* accessible from below through a lower access plane. A person using the pistol 1, relative to the upper cover section 4*b* of the slide 4, can engage the gripping access 5*a* from below with a finger.

The actuating member 5 includes a connecting mechanism 6 for connecting the actuating member 5 to the slide 4. According to the embodiment shown in FIGS. 2 to 6, the fastening mechanism 6 of the actuating member 5 comprises at least one engagement bridge 6*a* for insertion into at least one matching receiving groove 7 of the slide 4, wherein the at least one engagement bridge 6*a* extends away from the lower access plane of the gripping access 5*a* relative thereto and thereby from bottom to top. In the fully inserted position of the at least one engagement bridge 6*a*, the actuating member 5 is fixed to the slide 4. In the advantageous embodiment of the actuating member 5, a bottom-up direction corresponds to the orientation of the at least one engagement bridge. The gripping access accessible from below is thus accessible in the longitudinal direction of the engagement bridge 6*a*.

According to a further advantageous embodiment, a connecting member 8 leads from the fastening mechanism 6 to a grip plate 9 spaced from the fastening mechanism 6. The connecting member 8 leaves a central section between the fastening mechanism 6 and the grip plate 9 as gripping access 5*a* for access with a finger.

An advantageous embodiment of the actuating member 5, when arranged on the slide 4, does not project outwardly beyond the side walls 4*a* and preferably not beyond the upper cover section 4*b* of the slide 4.

In another advantageous embodiment of the actuating member 5, the connecting member 8 comprises at least two lateral wall sections which extend in the extension of the side walls 4*a* of the slide 4 when the actuating member 5 is fastened to the slide 4. If necessary, the actuating member 5 comprises, in addition to the two lateral wall sections, a cover section 10 which, in the case of an actuating member 5 fastened to the slide 4, extends in the extension of the upper cover section 4*b*. In an advantageous embodiment, the grip plate 9 forms the rear end face of the actuating member 5. The central section for access with a finger, or the gripping access 5*a*, is thus surrounded by the two lateral wall sections, the cover section 10, the grip plate 9 and the fastening mechanism 6, and is only accessible from below, or from the side facing away from the cover section 10.

Figure 7:
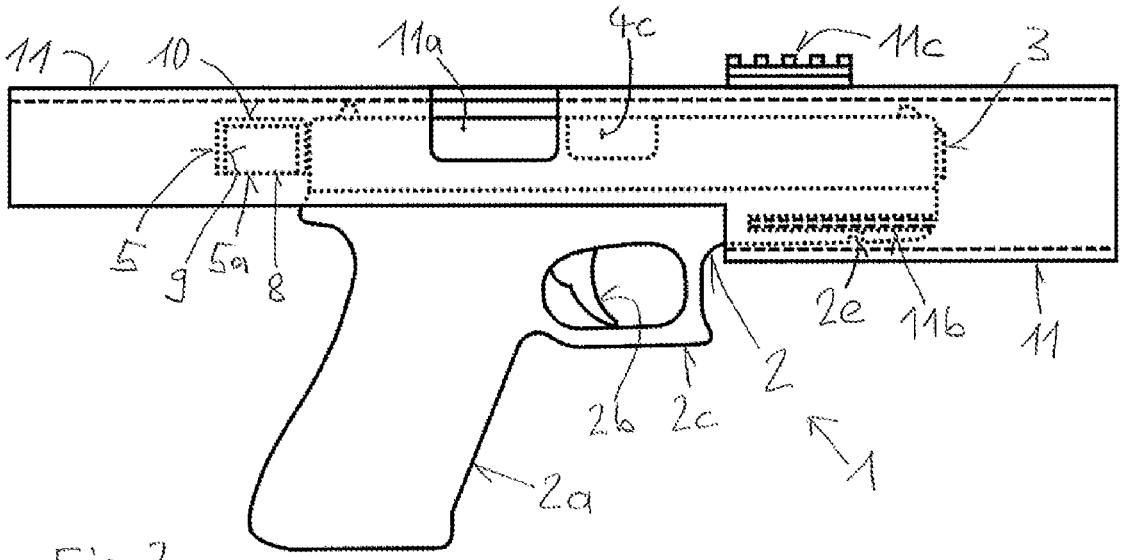
FIG. 7 is a schematic side view of a pistol having an actuating member located at the rear end of the slide and a housing fastened to the grip section of the pistol.

In addition to the actuating member 5, an advantageous embodiment of the pistol accessory according to FIG. 7 comprises a housing 11, which can be fastened to the grip section 2 of the pistol 1. In the fastened state, the housing 11 encloses the slide 4 and the actuating member 5 fastened to the slide 4 in all slide positions at least laterally and at the top. In a lateral and upper section, the housing 11 has an ejection opening 11*a* associated with the ejection window 4*c* of the slide 4, so that a cartridge case exiting the ejection window 4*c* also exits through the ejection opening 11*a*.

The housing 11 is open on its bottom side, at least at the actuating member, 5 so that it is possible to reach from below with a finger into the gripping access 5*a* of the actuating member 5. Preferably, the housing 11 at the actuating member 5 is open only on its bottom side. The actuating member 5 is then covered by the housing 11 at the sides and top in all slide positions.

Figure 8:
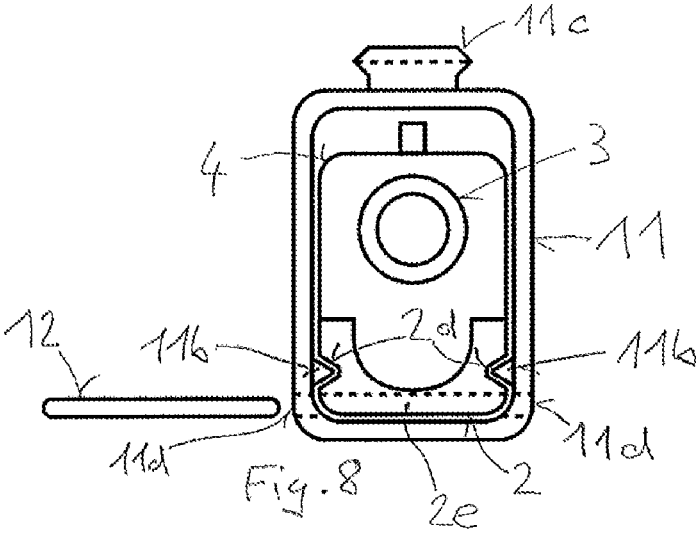
FIG. 8 is a schematic front view of the housing and the member of the pistol enclosed by it.

The housing 11 shown in FIGS. 7 and 8 comprises a fitting section 11*b* adapted to a corresponding holding section 2*d* of the grip section 2, so that the housing 11 can be fixed to the grip section 2 by a fitting movement over the barrel 3 of the pistol 1 along the longitudinal axis of the slide 4. In order to be able to lock the housing 11 in a desired fitting position on the grip section 2, a locking mechanism is formed between the grip section 2 and the housing 11. This comprises, for example, a bore 11*d* on the housing 11 transverse to the longitudinal axis, a locking groove 2*e* on the grip section 2 associated with this bore 11*d*, and a bolt 12 that can be inserted simultaneously into the bore 11*d* and the locking groove 2*e*.

In another advantageous embodiment of the housing 11, the housing includes at least one connecting section 11*c* configured to stably and accurately hold an aiming device. According to an advantageous embodiment, the connecting section 11*c* comprises at least one bridge to which a groove of the aiming device can be fixed.

The arrangement of the actuating member 5 and the housing 11 on the grip section 2 results in a pistol 1 according to the invention, which enables use according to the invention.

In the use according to the invention, the pistol 2 is held for a targeted firing by a person at the grip section 2 and at the housing 11, with one hand each, and is laterally supported with the housing 11 at a cheek of this person. With this three-point support of the pistol 1 according to the invention, there are no disturbing elements projecting laterally and moved with the slide 4, and the recoil from firing does not have to be absorbed in a direct line by a shoulder. The recoil only results in a movement of the housing 11 tangential to the jaw.

What is claimed is:

1. A pistol accessory with a connecting mechanism for connecting the pistol accessory to a pistol (1), which comprises a grip section (2), a barrel (3) and a slide (4) which is slidable relative to the grip section (2) and to the barrel (3), extends along a longitudinal axis and has two side walls (4*a*) and an upper cover section (4*b*) connecting the side walls (4*a*) at the top, as well as an ejection window (4*c*) for ejecting cartridge cases, wherein the pistol accessory comprises an actuating member (5) which can be fastened to the rear end of the slide (4) of a pistol (1), characterized in that the actuating member (5), in the state arranged on the slide (4), has a gripping access (5*a*) which is accessible from below through a lower access plane and into which a person using the pistol (1) can engage from below with a finger relative to the upper cover section (4*b*) of the slide (4).

2. The pistol accessory according to claim 1, characterized in that the actuating member (5) comprises a fastening mechanism (6) by means of which it can be fastened to the slide (4) at the rear end face, wherein the fastening mechanism (6) comprises at least one engagement bridge (6*a*) for insertion into at least one matching receiving groove (7) of the slide (4), wherein the at least one engagement bridge (6*a*) extends away from the lower access plane relative thereto and thereby from the bottom to the top, and wherein the gripping access (5*a*) accessible from below is accessible in the direction in which the engagement bridge (6*a*) extends.

3. The pistol accessory according to claim 2, characterized in that a connecting member (8) leads from the fastening mechanism (6) to a grip plate (9) spaced from the fastening mechanism (6), wherein the connecting member (8) between the fastening mechanism (6) and the grip plate (9) leaves a central section free as gripping access (5*a*) for access with a finger.

4. The pistol accessory according to claim 3, characterized in that said connecting member (8) comprises at least two lateral wall sections which, in the case of an actuating member (5) fastened to the slide (4), extend preferably in the extension of the side walls (4*a*) of the slide (4).

5. The pistol accessory according to claim 4, characterized in that the actuating member (5) comprises, in addition to the two lateral wall sections, a cover section (10) which, in the case of an actuating member (5) fastened to the slide (4), preferably extends in the extension of the upper cover section (4*b*).

6. The pistol accessory according to claim 5, characterized in that the grip plate (9) forms the rear end face of the actuating member (5).

7. The pistol accessory according to one of claims 1 to 6, characterized in that the pistol accessory comprises a housing (11) which can be fastened to the grip section (2) of the pistol (1), in the fastened state encloses the slide (4) and the actuating member (5) fastened to the slide (4) at least laterally and at the top in all slide positions, comprises an ejection opening (11*a*) in a lateral and upper section, which is assigned to the ejection window (4*c*) of the slide (4), and is open on its bottom side at least at the actuating member (5), so that it is possible to reach from below with a finger into the gripping access (5*a*) of the actuating member (5).

8. The pistol accessory according to claim 7, characterized in that the housing comprises a fitting section (11*b*) adapted to a corresponding holding section (2*d*) of the grip section (2), so that the housing (11) can be fixed to the grip section (2) by a fitting movement over the barrel (3) of the pistol (1) along the longitudinal axis of the slide (4).

9. The pistol accessory according to claim 7, characterized in that said housing comprises at least one connecting section (11*c*) adapted to stably and accurately hold an aiming device and preferably comprising at least one bridge to which a groove of said aiming device can be fixed.

10. The pistol (1) with a pistol accessory according to claim 7, characterized in that the actuating member (5) is arranged on the slide (4) and the housing (11) is arranged on the grip section (2).

11. Use of a pistol (1) according to claim 7, characterized in that the pistol (1) is held for a targeted firing by a person at the grip section (2) and at the housing (11), with one hand each, and is laterally supported with the housing (11) at a cheek.

* * * * *